United States Patent [19]

Hight

[11] Patent Number: 4,695,284

[45] Date of Patent: Sep. 22, 1987

[54] COOL WATER FABRIC WASHING PROCESS USING A PARTICULATE DETERGENT CONTAINING A NONIONIC AND A FATTY ACID BUILDER SALT

[75] Inventor: Andrew T. Hight, South Wirral, England

[73] Assignee: Lever Brothers Company, New York, N.Y.

[21] Appl. No.: 741,042

[22] Filed: Jun. 4, 1985

[30] Foreign Application Priority Data

Jun. 15, 1984 [GB] United Kingdom ..... 8415302

[51] Int. Cl.[4] ..... C11D 1/66; C11D 9/22; C11D 10/4; C11D 11/02

[52] U.S. Cl. ..... 8/137; 252/89.1; 252/108; 252/109; 252/117; 252/131; 252/132; 252/134; 252/174.17; 252/174.21; 252/174.23; 252/174.25; 252/525; 252/544

[58] Field of Search ..... 252/108, 109, 131, 132, 252/134; 8/137

[56] References Cited

U.S. PATENT DOCUMENTS

| | | | |
|---|---|---|---|
| 1,968,628 | 7/1934 | Alton | 252/131 |
| 2,543,744 | 3/1951 | Fox | 252/132 |
| 3,769,222 | 10/1973 | Yurko | 252/174.21 |
| 3,907,702 | 9/1975 | Mostow | 252/370 |
| 3,915,878 | 10/1975 | Yurko | 252/174.21 |
| 4,379,069 | 4/1983 | Rapisarda et al. | 252/135 |
| 4,473,485 | 9/1984 | Greene | 252/174.12 |
| 4,530,774 | 7/1985 | Davies | 252/108 |

FOREIGN PATENT DOCUMENTS

| | | | |
|---|---|---|---|
| 458711 | 1/1974 | Australia . | |
| 2090183 | 1/1976 | Australia . | |
| 548962 | 7/1977 | Australia . | |
| 542414 | 6/1957 | Canada | 252/109 |
| 0113978 | 7/1984 | European Pat. Off. | 252/121 |
| 1383407 | 2/1975 | United Kingdom . | |

*Primary Examiner*—Dennis L. Albrecht

*Attorney, Agent, or Firm*—Milton L. Honig; James J. Farrell

[57] ABSTRACT

A method for washing fabrics at cold water temperatures is provided wherein fabrics are contacted below 50° C. with built detergent particles comprising from 5 to 50% by weight of nonionic detergent active compound, from 15 to 90% by weight of a saturated fatty acid builder salt and from 5 to 80% carrier material chosen from water-insoluble inorganic materials, water-soluble inorganic materials, water-soluble organic materials, or mixtures thereof. The particles are prepared by distributing the aforementioned components in water, mixing the combination, and evaporating water therefrom to obtain the built particles. These built detergent particles are adapted to promote rapid dissolution or dispersion of the particle on contact with water.

17 Claims, No Drawings

COOL WATER FABRIC WASHING PROCESS USING A PARTICULATE DETERGENT CONTAINING A NONIONIC AND A FATTY ACID BUILDER SALT

TECHNICAL FIELD

This invention relates to built detergent compositions and their use in the washing of fabrics.

BACKGROUND

Detergent manufacturers have long recognised the need to control water hardness to ensure adequate cleaning by detergents. The detergency builders used in the past for this purpose have been of three main types, namely water-soluble sequestering builders, water-insoluble ion exchange builders and water-soluble precipitating builders. A typical precipitating builder is an alkali metal carbonate, especially sodium carbonate. Other water-soluble precipitating builders include sodium silicate (particularly effective against magnesium hardness), sodium orthophosphate and water-soluble alkali metal soaps.

The calcium ion concentration in a wash liquor can be reduced to sufficiently low levels by the use of, for example, a sequestering builder material such as sodium tripolyphosphate, and for this reason, considerable commercial success has been achieved with phosphate-built formulations. However, it has now become apparent that, under some conditions, the discharge of significant quantities of phosphates into waste waters may produce environmental problems. There is therefore an increasing desire in some countries to reduce the level of phosphorus in detergent compositions.

It has previously been thought that it was essential for precipitating builders to be substantially soluble at the temperature of use to achieve efficient water softening. With the present trend towards washing fabrics at lower temperatures with a view to saving energy costs, it has not previously been thought possible to use, as a precipitating builder material, materials which themselves are not substantially soluble in water at low temperatures. Thus, fatty acid salts which are not substantially soluble in water at room temperature, have not previously been proposed for use as precipitating builder materials at low wash temperatures.

We have now surprisingly found that certain fatty acid salts, which are not substantially soluble in cold water, can be incorporated together with a selected detergent active compound and a special carrier material into a solid particle, which can exhibit rapid dissolution or dispersion in, and efficient building of calcium-hard water, even at low temperatures. These built detergent particles can be used with or without other detergent active components and detergent adjuncts for use in the washing of fabrics.

DEFINITION OF INVENTION

Thus, according to the invention, there is provided a particulate built detergent composition comprising:

(i) from 5 to 50% by weight of nonionic detergent active compound;

(ii) from 15 to 90% by weight of a saturated fatty acid builder salt containing at least 16 carbon atoms, or mixtures thereof; and (iii) from 5 to 80% by weight of a carrier material chosen from water-insoluble inorganic materials, water-soluble inorganic materials, water-soluble organic materials, or mixtures thereof.

DISCLOSURE OF THE INVENTION

Built Detergent Particles

The built detergent particles essentially comprise an intimate mixture of nonionic detergent active compound, a salt of a saturated fatty acid as a builder and a carrier material which is adapted to promote rapid dissolution or dispersion of the particle on contact with water.

The Nonionic Detergent Active Compound

Suitable nonionic detergent active compounds which can be used as a constituent of the built detergent particles according to the invention include in particular the reaction products of compounds having a hydrophobic group and a reactive hydrogen atom, for example aliphatic alcohols, acids, amides or alkyl phenols containing from 6 to 22 carbon atoms with one or more additional alkylene oxide groups, especially ethylene oxide either alone or with propylene oxide. Specific nonionic detergent compounds are alkyl ($C_6$ to $C_{22}$) phenol-ethylene oxide condensates, generally with 5 to 25 units of ethylene oxide per molecule, the condensation products of aliphatic ($C_8$ to $C_{18}$) primary or secondary linear or branched alcohols with ethylene oxide, generally with 3 to 40 units of ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides. Mixtures of nonionic detergent active compounds can also be employed.

The amount of nonionic detergent active compound present in the builder particles should form from 5 to 50%, preferably from 10 to 40% by weight of the builder particles.

The Fatty Acid Salt

Suitable fatty acid salts which can be used as the builder constituent of the built detergent particles according to the invention are those which are conventionally used in soap manufacture and which are accordingly saturated and contain at least 16 carbon atoms, preferably not more than 18 carbon atoms. Fatty acid salts containing less than 16 carbon atoms are not only much more expensive but are in any case less suitable for the present purposes, their corresponding calcium salts having a solubility product which is not sufficiently low for acceptable building to be possible, when used at similar dosages to the conventional fatty acid salts. Salts of fatty acids derived from natural sources will normally contain a mixture of alkyl chain lengths, and may often contain unsaturated and/or hydroxy-substituted alkyl chains. In such circumstances it is essential that at least 30%, preferably at least 40% of the fatty acid consists of acids which are saturated and contain at least 16 carbon atoms, preferably from 16 to 18 carbon atoms.

The fatty acid salts include not only the alkali metal salts of the above fatty acids but also the organic salts which can be formed by complexing fatty acids with organic nitrogen-containing materials such as amines and derivatives thereof.

Preferred examples of fatty acid salts include sodium stearate, sodium palmitate, sodium salts of tallow and palm oil fatty acids and complexes between stearic and/or palmitic fatty acid and/or tallow and/or palm oil fatty acids with water-soluble alkanolomides such as ethanolamine, di- or tri- ethanolamine, N-methylethanolamine, N-ethylethanolamine, 2-methylethanolamine and 2,2-dimethyl ethanolamine and N-containing ring compounds such as morpholine, 2'-pyrrolidone and their methyl derivatives.

Mixtures of fatty acid salts, and mixtures of fatty acids with fatty acid salts can also be employed.

The amount of fatty acid salt present in the built detergent particles should accordingly form from 15 to 90%, preferably from 25 to 80% and ideally 30 to 55% by weight of the particles.

The Carrier Material

Suitable carrier materials which can be used as a constituent of the built detergent particles according to the invention should be chosen from water-insoluble inorganic materials, water-soluble inorganic materials, water-soluble organic materials or mixtures thereof.

Preferred examples of suitable water-insoluble inorganic materials are naturally occurring silicas, precipitated silicas and silica gels; alumina and alumino silicate materials including zeolites, kaolin, talc and clays; and mixtures thereof.

Preferred examples of suitable water-soluble inorganic materials include sodium perborate; mono-, di- and tri- valent metal sulphates such as alkali metal sulphates; alkali metal phosphates such as sodium tripolyphosphate, pyrophosphate or orthophosphate; alkali metal carbonates such as sodium carbonate, sodium bicarbonate or sodium sesquicarbonate and their mixed carbonates; sodium and potassium chloride; and mixtures thereof.

Preferred examples of water-soluble organic materials are urea; carbohydrates, especially crystalline sugars such as sucrose; solid, preferably crystalline polyhydric alcohols, such as penta erythritol, sorbitol and mannitol; water-soluble film-forming materials such as polysaccharides, especially derivatives of starch and cellulose; synthetic polymers such as polyacrylates; proteins such as gelatin; dicarboxylic acids and their salts; and mixtures thereof.

The amount of carrier material present in the built detergent particles should be from 5 to 80%, preferably from 15 to 60% and ideally from 20 to 50% by weight of the built detergent particles.

When determining the appropriate quantity of nonionic detergent active compound, fatty acid salt and carrier material to be used to form the built detergents particles, the following consideration should also be taken into account. Firstly, the weight ratio of nonionic detergent active compound to fatty acid salt in the particles should be from 2:1 to 1:8. Secondly, the weight ratio of fatty acid salts to carrier material in the particles should be from 10:1 to 1:4, preferably from 1:2 to 2:1.

Optional Structurant

The built detergent particles may further contain a material for improving the structure thereof. Such materials may be water-soluble inorganic salts such as sodium silicate.

PROCESS FOR MANUFACTURE OF BUILT DETERGENT PARTICLES

The built detergent particles can be made by a variety of techniques, such as by conventional spray-drying, by spray-cooling or granulation techniques, adapted to provide intimate mixing of nonionic detergent active compound, fatty acid salt and carrier material.

Alternatively, a hot aqueous solution of the nonionic detergent active material, the fatty acid salt and the carrier material can be evaporated to dryness with constant agitation and the resultant solid material ground to the desired particle size. Where the carrier material is insoluble in water, it may be dispersed in a solution of the other components.

The carrier material can be milled to smaller particle sizes (e.g. using a swing-hammer mill) before the fatty acid salt/nonionic detergent-active compound solution is applied so as to increase the weight of fatty acid salt/nonionic detergent active compound that can be carried by a given weight of said carrier material.

The size of the built detergent particles, as measured by sieve analysis, should be such that the majority of the particles have a size between 100 μm and 1500 μm, preferably between 180 μm and 1200 μm.

DETERGENT PRODUCTS

The particulate built detergent composition according to the invention can be employed alone, for example in the washing of fabrics, or it can form an ingredient of a detergent product which comprises other ingredients. In particular the detergent product can comprise detergent active compounds and detergent adjuncts, in addition to those present in the built detergent particles.

Other Detergent Active Compounds

Optionally present additional detergent active compounds can be selected from anionic, nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

Examples of such detergent compounds which optionally can be used are synthetic anionic and nonionic compounds. The former are usually water-soluble alkali metal salts of organic sulphates and sulphonates having alkyl radicals containing from 8 to 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) ) benzene sulphonates; sodium alkyl glyceryl ether sulphates, especially those ethers of the higher alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Examples of suitable nonionic detergent active compounds that optionally can be employed in the detergent composition in addition to the built detergent particles are those which are suitable for use in the particles themselves.

Mixtures of detergent compounds, for example mixed anionic or mixed anionic and nonionic compounds may be used in the detergent compositions, particularly in the latter case to provide controlled low sudsing properties. This is beneficial for composition intended for use in suds-intolerant automatic washing machines.

Amphoteric or zwitterionic detergent active compounds can optionally also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

Cold water-soluble soaps can optionally also be present in the detergent compositions of the invention, in addition to the fatty acid salts which comprise the builder particles. The soaps are particularly useful at low levels in binary and ternary mixtures, together with nonionic or mixed synthetic anionic and nonionic detergent compounds, which have low sudsing properties. The soaps which are used are the water-soluble salts of saturated or unsaturated fatty acids in particular with inorganic cations such as sodium and potassium. The amount of such soaps can be between 2% and 20%, especially between 5% and 15%, can advantageously be used to give a beneficial effect on detergency.

Other Detergency Builders

The detergent product can optionally contain further builder materials, in addition to the fatty acid salt which forms part of the built detergent particles.

Any such further builder materials can be selected from precipitating builder materials, optionally together with a precipitation seed material, or from sequestering builder materials and ion-exchange builder materials, and materials capable of forming such builder materials in situ.

Where the further builder material is a water-soluble precipitating material, it can be selected from soaps, alkyl malonates, alkyl or alkenyl succinates, sodium fatty acid sulphonates, orthophosphates of sodium, potassium and ammonium, or in their water-soluble partially or fully acidified forms. Particularly where the hard water contains magnesium ions, the silicates of sodium and potassium can be employed.

When the further builder material is a water-soluble inorganic sequestering material, it can be selected from pyrophosphates, polyphosphates, polyphosphonates, and polyhydroxysulfonates.

Specified examples of inorganic phosphate sequestering builders include sodium and potassium tripolyphosphates, pyrophosphates, and polymerphosphates such as hexametaphosphate or glassy phosphates. The polyphosphonates specifically include, for example, the sodium and potassium salts of ethane 1-hydroxy-1,1-diphosphonic acid and the sodium and potassium salts of ethane-1,1,2-triphosphonic acid.

Where the further builder material is a water-soluble organic sequestering material, it can be selected from the alkali metal, ammonium and substituted ammonium salts of polyacetates, carboxylates, polycarboxylates, polyacetylcarboxylates and polyhydroxysulfonates.

Specific examples of the polyacetate and polycarboxylate builder salts include sodium, potassium, ammonium and substituted ammonium salts of ethylene diamine tetraacetic acid, nitriloacetic acid, dipicolinic acid, oxydisuccinic acid, benzene polycarboxylic acids, such as mellitic acid, and citric acid. The acid forms of these materials may also be used.

Where the further builder material is an ion-exchange material, it can be selected from ion-exchange materials such as the amorphous or crystalline alumino-silicates.

Alkaline Material

The detergent products preferably give an alkaline reaction when dispersed in water. Preferably, the compositions should yield a pH value of at least 8.0, most preferably from 9.5 to 11 in use in aqueous wash solution. The pH is measured at the lowest normal usage concentration of 0.1% w/v of the composition in water of 12° FH (Ca) (French permanent hardness, calcium only) at 25° C. so that a satisfactory degree of alkalinity can be assured in use at all normal concentrations.

The alkaline material can be selected from alkali metal and ammonium salts of weak acids such as alkali metal and ammonium carbonates including sodium carbonate and sodium sesquicarbonate, alkali metal and ammonium silicates including sodium alkaline silicate, alkali metal and ammonium phosphates including sodium orthophosphate, alkali metal hydroxides including sodium hydroxides, alkali metal borates and the alkali metal and ammonium water-soluble salts of weak organic acids including sodium citrate, sodium acetate, and the cold water soluble soaps such as sodium oleate, and mixtures of such materials.

In some cases the alkaline material will itself also act as a builder. Thus, for example, sodium carbonate will contribute to building by precipitation of calcium carbonate while sodium citrate will contribute to building by sequestering calcium ions. In this case it can be beneficial to include, as an alkaline material, a material which is relatively calcium insensitive, such as sodium silicate, so as to maintain a high pH throughout the wash. The other ingredients in the detergent compositions of the invention should of course be chosen for alkaline stability, especially pH-sensitive materials such as enzymes.

Other Detergent Adjuncts

Apart from the detergent active compounds and detergency builders, which optionally can be present in the detergent products, other adjuncts in the amounts normally employed in fabric washing detergent products can also optionally be present. Examples of such optional detergent adjuncts include lather boosters such as alkanolamines, particularly the mono-ethanolamides derived from palm kernel fatty acids and coconut fatty acids, lather depressants such as alkyl phosphate, long-chain fatty acids or soaps thereof, waxes and silicones, anti-redeposition agents such as sodium carboxymethylcellulose and cellulose ethers, oxygen-releasing bleaching agents such as sodium perborate and sodium percarbonate, per-acid bleach precursors, such as tetraacetylethylenediamine (TAED), chlorine-releasing bleaching agents such as trichloroisocyanuric acid, fabric softening agents, inorganic salts, such as sodium sulphate, and magnesium silicate, and in very minor amounts, fluorescent agents, perfumes, enzymes such as proteases and amylases, germicides and colourants.

It is particularly beneficial to include in the detergent products an amount of sodium perborate or percarbonate, preferably between 10 and 40%, preferably from 15 to 30% by weight, together with TAED.

It is particularly desirable optionally also to include one or more other antideposition agents such as anionic poly electrolytes, especially polymeric aliphatic carboxylates in the detergent products of the invention, to further decrease the tendency to form inorganic deposits on washed fabrics. The amount of any such antideposition agent can be from 0.01 to 5% by weight, preferably from 0.2 to 2% by weight of the products.

Specific preferred antideposition agents, if used, are the alkali metal or ammonium, preferably the sodium, salts or homo- and co-polymers of acrylic acid or substituted acrylic acids, such as sodium polyacrylate, the sodium salt of copolymethacrylamide/acrylic acid and sodium poly-alphahydroxyacrylate, salts of copolymers of maleic anhydride with ethylene, acrylic acids, vinylmethylether allyl acetate or styrene, especially 1:1 copolymers, and optionally with partial esterification of the carboxyl groups. Such copolymers preferably have relatively low molecular weights, for example in the range of 1,000 to 50,000. Other antideposition agents can include the sodium salts of polyitaconic acid and polyaspartic acid, phosphate esters of ethoxylated aliphatic alcohols, polyethylene glycol phosphate esters, and certain phosphonates such as sodium ethane-1-hydroxy-1,1-diphosphonate, sodium ethylenediamine tetramethylene phosphonate, and sodium 2-phosphonobutane tri carboxylate. Mixtures of organic phosphonic acids or substituted acids or their salts with protective colloids such as gelatin can also be used. The most preferred antideposition agent, if used, is sodium polyacrylate having a MW of 10,000 to 50,000, for example 20,000 to 30,000.

Even if an alkaline material other than an alkali metal silicate is included in the composition, it is generally also desirable, though not essential, to include an amount of an alkali metal silicate, to decrease the corrosion of metal parts in washing machines and provide processing benefits and generally improved powder properties. The presence of such alkali metal silicates, particularly sodium ortho-, meta- or preferably neutral or alkaline silicate, at levels of at least about 1%, and preferably from 5 to 15% by weight of the composition, can be advantageous. The more highly alkaline ortho- and meta- silicates would normally only be used at lower amounts within this range, in admixture with the neutral or alkaline silicates.

Preferred Detergent Product

A preferred detergent product comprises by weight of the composition:

(i) from 2.0 to 30% of at least one non-soap detergent active material;

(ii) at least 3% of an alkaline material; and (iii) sufficient of the built detergent particles according to the invention to provide at least 15% by weight of fatty acid salt.

The non-soap detergent active material and the alkaline material of the detergent product can be incorporated in the built detergent particle and/or can be separate therefrom.

MANUFACTURE OF THE DETERGENT PRODUCT

The detergent products should be solid particulate products. Dry-mixing and granulation of all components may be used or alternatively the fatty acid salt containing builder particles may be post-dosed to a spray-dried base powder.

USE OF THE BUILT DETERGENT PARTICLES AND DETERGENT COMPOSITIONS CONTAINING THEM

The built detergent particles and detergent compositions containing them can be used in hand washing, if desired, but they are preferably employed in a domestic or commercial laundry washing machine. The latter permits the use of higher alkalinity, and more effective agitation, all of which contribute generally to better detergency. The type of washing machine used, if any, is not important.

The built detergent particles and detergent compositions are particularly suitable for washing fabrics at low temperatures i.e. below 50° C., even below 35° C. Successful results can also be achieved at temperatures above 50° C.

EXAMPLES OF THE BUILT DETERGENT PARTICLES

The invention will now be further illustrated with reference to the following Examples.

EXAMPLE 1

Built detergent particles according to the invention were added at a temperature of 25° C. to water having a hardness of 20° FH. (Ca).

The particles consisting of equal parts by weight of:

sodium palmitate; SYNPERONIC A7 (a nonionic surfactant consisting of $C_{13-15}$ ethoxylated fatty alcohol containing an average of 7 ethylene oxide groups); and sucrose, were prepared by dissolving the soap, the nonionic and the sucrose in hot (80° C.) deionised water, stirring until a clear solution was obtained and then evaporating to dryness with constant stirring. The resulting solid was then oven-dried for 24 hours at 100° C. before grinding and sieving to the required particle size of from 180 to 850 μm.

3 g of the particles (containing approximately 1 g of soap) were added to 500 ml hard water, and by the use of a calcium sensitive electrode, the concentration of free calcium ions after 1, 2 and 5 minutes was measured. Also, the weight of total insoluble matter was measured gravimetrically.

In order to illustrate the importance of including in the built detergent particles of the invention, both a nonionic surfactant and a carrier material, in addition to the fatty acid salt, particles in which either the carrier, or both the carrier and the nonionic surfactant had been omitted were prepared and tested as described above.

The results obtained are tabulated below:

TABLE I

| Built detergent particle ingredients | Free Calcium (°FH) by calcium sensitive electrode after: 1 min | 2 mins | 5 mins | Weight of total insolubles (g) after 5 minutes |
|---|---|---|---|---|
| sodium palmitate | 19.5 | 19.0 | 18.5 | 0.93 |
| sodium palmitate + SYNPERONIC A7 | 8.4 | 5.5 | 2.9 | 0.55 |
| sodium palmitate + SYNPERONIC A7 + sucrose | 1.7 | 0.052 | <0.01 | 0.24 |

This Example demonstrates the benefit of including sucrose in the built detergent particles as a carrier, in that the free calcium expressed as °FH. drops rapidly from 20° FH. to <0.01° FH. in under five minutes. The corresponding built detergent particles without sucrose produce a much less significant reduction in hardness. Furthermore, the weight of insoluble matter remaining after 5 minutes is least when sucrose is incorporated into the builder particles, together with sodium palmitate and SYNPERONIC A7.

EXAMPLE 2

The procedure of Example 1 was repeated, except that urea and bentonite were employed separately as replacements for sucrose as the carrier material. In the case of the particles containing bentonite the processing was modified by dispersing the bentonite in the hot solution of the other components.

The results obtained are tabulated below:

TABLE II

| Built detergent particle ingredients | Free Calcium (°FH) by calcium sensitive electrode after: 1 min | 2 mins | 5 mins | Weight of total insolubles (g) after 5 minutes |
|---|---|---|---|---|
| sodium palmitate + SYNPERONIC A7 + urea | 1.9 | 0.016 | <0.01 | 0.20 |
| sodium palmitate + SYNPERONIC A7 + bentonite | 0.03 | <0.01 | <0.01 | 0.02 |

This Example, when compared with the results set out under Example 1, demonstrates that urea is as effective as sucrose in promoting the rapid softening the hard water (to a value of <0.01° FH. from 20° FH.) in under 5 minutes. The weight of insoluble matter remaining is equivalent to that when sucrose is employed as the carrier material.

The effect of employing bentonite instead of sucrose is even more dramatic, the reduction in water hardness to a low value of <0.01° FH. occurring in less than 2 minutes. The weight of insoluble material recovered in this instance is also insignificant.

EXAMPLE 3

The procedure of Example 1 was repeated using different carrier materials. These included dextranised starch, kaolin, talc, zeolite, a precipitated silica, sodium chloride and potassium chloride.

In each case the built detergent particles contained equal parts by weight of sodium palmitate, SYNPERONIC A7 and the specified carrier material. The dosage of particles was 3 g (i.e. 1 g soap) in 500 ml water at 20° FH. at 25° C.

The results are set out in Table III below.

TABLE III

| Carrier material | Free calcium (°FH) by calcium sensitive electrode after: 1 min | 2 mins | 5 mins | Weight of total insolubles (g) after: 5 mins |
|---|---|---|---|---|
| dextranised starch | 1.15 | 0.01 | <0.01 | 0.18 |
| Kaolin | 3.0 | 0.02 | <0.01 | — |
| talc | 0.9 | <0.01 | <0.01 | 0.33 |
| zeolite | 0.09 | <0.01 | <0.01 | 0.48 |
| precipitated silica | 2.65 | 0.66 | <0.01 | 0.29 |
| sodium chloride | 6.0 | 0.85 | <0.01 | 0.46 |
| potassium chloride | 0.85 | <0.01 | <0.01 | 0.14 |

This Example, when compared with the results set out under Example 1, demonstrates that each of the alternative carriers tested is as effective as sucrose in promoting the rapid softening of the hard water (to a value of <0.01° FH. from 20° FH.) in under 5 minutes. The weight of insoluble matter remaining is of the same order as that when sucrose is employed as the carrier material.

The effect of employing talc, zeolite or potassium chloride instead of sucrose is even more dramatic, the reduction in water hardness to a low value of <0.01° FH. occurring in less than 2 minutes. The weight of insoluble material recovered in each of these instances is also insignificant.

I claim:

1. A method for washing fabrics at cold water temperatures comprising contacting said fabrics below 5020 C. with built detergent particles comprising:

(i) from 5 to 50% by weight of a nonionic detergent active compound;

(ii) from 15 to 90% by weight of a saturated fatty acid builder salt containing at least 16 carbon atoms, or mixtures thereof; and (iii) from 5 to 80% by weight of a carrier material, the carrier material being chosen from water-insoluble inorganic materials, water-soluble inorganic materials, water-soluble organic materials selected from the group consisting of urea, solid polyhydric alcohols, polysaccharides, synthetic polymers, proteins, and mixtures thereof; and wherein said particles are prepared by distributing said nonionic active, said fatty acid builder salt, and said carrier material in water to form an aqueous solution and/or dispersion, mixing said combination, and evaporating water therefrom to obtain said built particles.

2. The method of claim 1, wherein the nonionic detergent active compound is alkoxylated.

3. The method of claim 1, wherein the nonionic detergent active compound forms from 10 to 40% by weight of the built detergent particles.

4. The method of claim 1, wherein the saturated fatty acid salt contains from 16 to 18 carbon atoms.

5. The method of claim 4, wherein the saturated fatty acid salt is chosen from salts of palmitic acid and stearic acid.

6. The method of claim 1, wherein the saturated fatty acid salt forms from 25 to 80% by weight of the built detergent particles.

7. The method of claim 1, wherein the carrier material is a water-soluble inorganic material chosen from perborates, sulphates, phosphates, chlorides, carbonates and mixtures thereof.

8. The method of claim 7, wherein the carrier material is chosen from sodium and potassium chloride.

9. The method of claim 1, wherein the carrier forms from 15 to 60% by weight of the builder particles.

10. The method of claim 1, wherein the weight ratio in the built detergent particles of nonionic detergent active compound to fatty acid salt is from 2:1 to 1:8.

11. The method according of claim 1, wherein the weight ratio in the built detergent particle of fatty acid salts to carrier material is 10:1 to 1:4.

12. The method of claim 1, wherein the built detergent particles have an average particle size of from 100 to 1500 μm.

13. A method according to claim 1 for washing fabrics employing a detergent product comprising the built detergent composition method particles of claim 1, blended together with other ingredients in an amount up to 75% by weight of the composition, said other ingredients being chosen from: (a) detergent active compounds, selected from the group consisting of anionic, nonionic, zwitterionic and amphoteric synthetic detergent active material; (b) detergency builders, selected from the group consisting of precipitating builder materials, sequestering builder materials and ion-exchange builder materials and materials capable of forming such builders in situ; (c) alkaline materials, selected from the group consisting of alkali metal and ammonium salts of carbonates, silicates, phosphates, citrates, acetates, oleates and alkali metal hydroxides and borates; and (d) other detergent adjuncts, selected from the following: lather boosters, lather depressants, waxes, silicones, antiredeposition agents, oxygen-releasing agents, chlorine-releasing agents, peracid bleach precursors, fabric softening agents, inorganic salts, fluorescent agents, perfumes, enzymes, germicides and colourants.

14. A method for washing fabrics at cold water temperatures comprising cntacting said fabrics below 50° C. with built detergent particles comprising:

(i) from 5 to 50% by weight of nonionic detergent active compound;

(ii) from 15 to 90% by weight of a saturated fatty acid builder salt containing at least 16 carbon atoms, or mixtures thereof; and (ii) from 5 to 80% by weight of a carrier material, the carrier being a water-insoluble inorganic material selected from the following: naturally occurring silice, precipitated silica, silica gels, alumina and aluminosilicates, clays and mixtures thereof; and wherein said particles are prepared by distributing said nonionic active, said fatty acid builder salt, and said carrier material in water to form an aqueous solution and/or dispersion, mixing said combination, and evaporating water therefrom to obtain said built particles.

15. The method of claim 14, wherein the carrier material is bentonite clay.

16. A method for washing fabrics at cold water temperatures comprising contacting said fabrics below 50° C. with built detergent particles comprising:

(i) from 5 to 50% by weight of a nonionic detergent active compound;

(ii) from 15 to 90% by weight of a saturated fatty acid builder sodium salt containing at least 16 carbon atoms, or mixtures thereof; and (iii) from 5 to 80% by weight of a carrier material, the carrier material being chosen from water-insoluble inorganic materials, water-soluble inorganic materials, water-soluble organic materials selected from the group consisting of urea, crystalline sugars, polyhydric alcohols, amides, synthetic polymers, proteins and mixtures thereof; and wherein said particles are prepared by distributing said nonionic active, said fatty acid builder salt, and said carrier material in water to form an aqueous solution and/or dispersion, mixing said combination, and evaporating water therefrom to obtain said built particles.

17. The method of claim 16 wherein the carrier material is sucrose.

* * * * *

UNITED STATES PATENT AND TRADEMARK OFFICE

CERTIFICATE OF CORRECTION

PATENT NO. : 4,695,284

DATED : September 22, 1987

INVENTOR(S) : Andrew T. Hight

It is certified that error appears in the above—identified patent and that said Letters Patent is hereby corrected as shown below:

Column 10, line 31, change "5020" to -- 50° --.

Signed and Sealed this

Twenty-third Day of February, 1988

*Attest:*

DONALD J. QUIGG

*Attesting Officer*

*Commissioner of Patents and Trademarks*